United States Patent [19]

Yamada

[11] Patent Number: 4,843,831

[45] Date of Patent: Jul. 4, 1989

[54] REFRIGERATOR CONTROL SYSTEM

[75] Inventor: Koji Yamada, Ibaraki, Japan

[73] Assignee: Kabushiki Kaisha Toshiba, Kawasaki, Japan

[21] Appl. No.: 160,014

[22] Filed: Feb. 24, 1988

[30] Foreign Application Priority Data

Feb. 27, 1987 [JP] Japan ..... 62-029076

[51] Int. Cl.[4] ..... F25D 21/06

[52] U.S. Cl. ..... 62/155; 62/156; 62/199; 62/201

[58] Field of Search ..... 62/155, 186, 199, 200, 62/229, 154, 234, 185, 333, 332, 334, 335, 201

[56] References Cited

U.S. PATENT DOCUMENTS

| | | | |
|---|---|---|---|
| 2,576,663 | 11/1951 | Atchison | 62/199 |
| 3,603,379 | 9/1971 | Leonard, Jr. | 62/333 X |
| 3,854,916 | 12/1974 | Dochterman | 62/155 X |
| 3,890,798 | 6/1975 | Fujimoto et al. | 62/234 X |
| 4,269,035 | 5/1981 | Gelbard | 62/155 |
| 4,406,138 | 9/1983 | Nelson | 62/185 |
| 4,569,205 | 2/1986 | Dempou et al. | 62/155 |

FOREIGN PATENT DOCUMENTS 53-10586 3/1978 Japan .

*Primary Examiner*—Harry B. Tanner

*Attorney, Agent, or Firm*—Cushman, Darby & Cushman

[57] ABSTRACT

A cold accumulation type refrigerator having an improved control system for controlling its defrost cycle. The refrigerator includes a main evaporator for producing cold air, a cooling command signal generating device for generating a cooling command signal when a refrigerator compartment is required to be cooled, a clock device for generating a time data, a refrigerating cycle for cooling the main evaporator in accordance with the cooling command signal and the cold-accumulation material in accordance with the time data from the clock device, and a defrost control device for removing frost deposited on the main evaporator. The defrost control device counts cooling operation time of the evaporator in response to the cooling command signal. If the refrigerator is a fan cool type refrigerator whose evaporator is provided with a cold air circulation fan, the defrost control device counts the operation time of the fan, and when a prescribed time count, such as twelve hours, has been completed, the defrost control device generates a defrost starting signal, whereby a proper defrosting operation is carried out even in the cold-accumulation type refrigerator.

15 Claims, 4 Drawing Sheets

FIG. 6
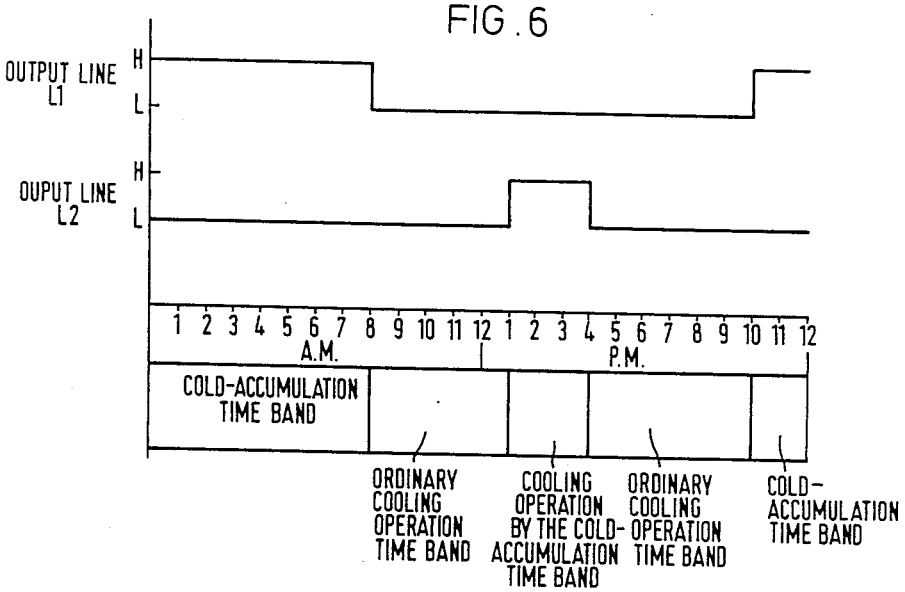
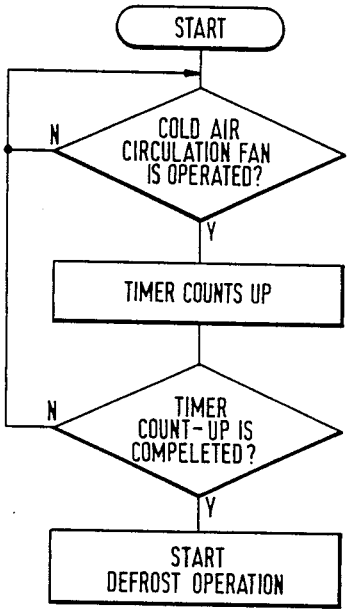
FIG. 7

REFRIGERATOR CONTROL SYSTEM

BACKGROUND OF THE INVENTION

1. Field of the Invention

The present invention relates, in general, to a control system of refrigerator. More particularly, the invention provides a defrost control system for a refrigerator utilizing a cold-accumulation material.

2. Description of the Prior art

It is known to provide a cold-accumulation material in a refrigerating device, such as a refrigerator and an air conditioner to improve the operating efficiency of its refrigerating cycle. An example of such a refrigerating device is disclosed in Japanese Utility Model Publication No. 53-10586, filed on Oct. 9, 1973 in the name of Kenichi KAGAWA. In Japanese Utility Model Publication No. 53-10586, the refrigerating cycle has an auxiliary cooler and an auxiliary condenser located in a case containing the cold-accumulation material. The auxiliary cooler and the auxiliary condenser are connected in parallel fluid circuit with each other. When a load to be cooled by the refrigerator is small, the auxiliary cooler cools the cold-accumulation material thereby accumulating "extra" cooling capacity of the refrigerating cycle in the cold-accumulation material. When the load to be cooled is large the auxiliary condenser compensates for an insufficient condensing capacity of a main condenser exchanging heat with the cold-accumulation material. Thereby, the efficiency of the refrigerating cycle, especially the operating efficiency of its compressor, is improved.

Recently, cold-accumulation materials have been placed in refrigerators for the purpose of evening out power demand during a 24-hour day by utilizing power which would otherwise not be efficiently used, such as, for example, night-time power. Such a refrigerators is, for example, constituted as follows.

A refrigerating cycle is established including a main evaporator for cooling a refrigerator compartment and a cold-accumulation evaporator for cooling the cold-accumulation material. Refrigerant is selectively supplied to the main evaporator and the cold-accumulation evaporator. A cold-air circulation fan is provided in association with the main evaporator to supply and circulate cold air produced by the main evaporator in the interior of the compartment. The cold-accumulation material is installed in such a manner that it can be cooled by the cold-accumulation evaporator. A thermosiphon is provided in fluid circuit with the cold-accumulation material and the main evaporator. The thermosiphon comprises a closed-loop pipeline in which a working fluid circulates. This working fluid cools the main evaporator by transferring heat from the main evaporator to the cold-accumulation material. When there is little power demand, for example, in the middle of night, a compressor in the refrigerating cycle is actuated to supply refrigerant to the cold-accumulation evaporator thereby cooling the cold-accumulation material. For a set time band in the daytime when there is large demand for power, the compressor is not operated and the thermosiphon is made functional. The main evaporator is cooled by exchanging heat between the cold-accumulation material and this main evaporator through the thermosiphon while at the same time the interior of the compartment is cooled by the fan circulating the cold air produced thereby in the interior of the compartment.

A conventional refrigerator is provided with a defrosting device to remove frost accumulated on an evaporator periodically for ensuring optimum cooling efficiency. This defrosting device keeps track of the operation time of the compressor, and actuates a defrost heater when it has operated for a predetermined period of time, usually indicated by a count of a counter. In a conventional refrigerator, generally the amount of frost accumulated on the evaporator is proportional to the time during which air in the compartment flows past the evaporator. There is a definite relationship between the amount of frost accumulated and the compressor's cumulative operation time, since it hss been the practice to operate the compressor and the cold-air circulation fan simultaneously.

However, in a cold-accumulation type refrigerator such as described above, the relationship between the amount of frost and the compressor's cumulative operation time is not the same as for a refrigerator without a cold-accumulation material. Adhesion of frost to the evaporator occurs even when the refrigerator compartments are being cooled by the cold accumulation material by using the thermosiphon and the cold-air circulation fan.

Therefore, it is not appropriate or efficient to utilize the defrost cycle employed in a conventional refrigerator for a coldaccumulation type refrigerator.

SUMMARY OF THE INVENTION

It is an object of the present invention to provide an arrangement that will properly defrost a cold-accumulation material - type refrigerator.

To accomplish this object, the present invention provides a refrigerator with the cold-accumulation material including an evaporator for producing cold air, a cooling command generating device for generating a time data, a refrigerating cycle for cooling the evaporator in accordance with the cooling command signal and the cold-accumulation material in accordance with a time data, and a defrost control device for removing frost deposited on the evaporator. The defrost control device counts cooling time of the evaporator in response to the cooling command signal.

BRIEF DESCRIPTION OF THE DRAWINGS

The present invention will be further explained with reference to accompanying drawings in which:

FIG. 6 is a graphical representation explaining the operation of the present invention as a function of time; and FIG. 7 is a simplified flow-chart explaining the operation of a microcomputer-based control device in accordance with the present invention.

DETAILED DESCRIPTION OF THE PREFERRED EMBODIMENT

Referring to the accompanying drawings, a presently preferred and exemplary embodiment of the present invention will be described.

Figure 3:
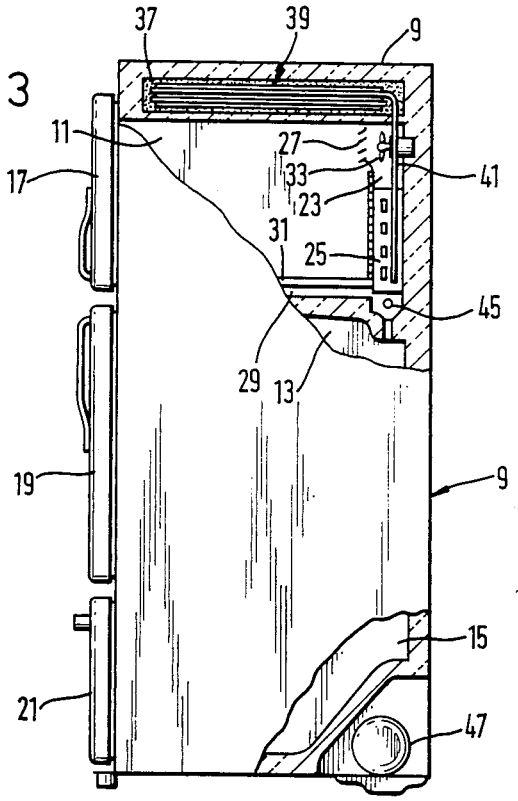
FIG. 3 is a side elevation partly in section of a refrigerator in accordance with the present invention.
Figure 4:
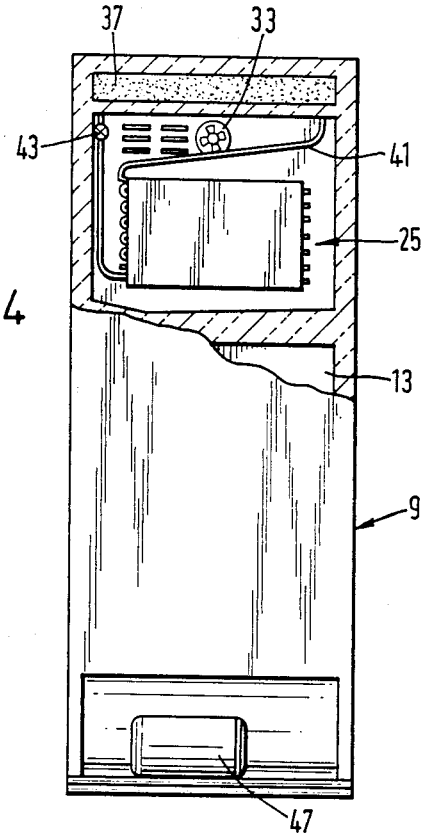
FIG. 4 is a elevation partly in section of a refrigerator in accordance with the present invention.
Figure 5:
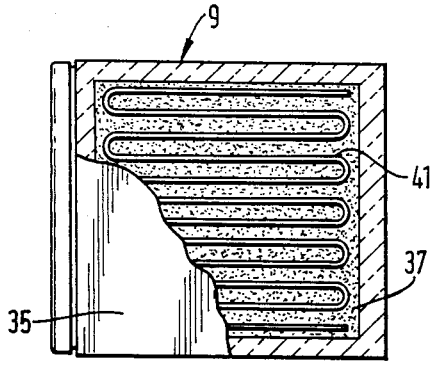
FIG. 5 is an enlarged view partly in section of a portion of a refrigerator in accordance with the present invention.

The overall construction of the refrigerator, which is one embodiment of the present invention, is shown in FIG. 3-5. The interior of a main body 9 of the refrigerator is divided into a freezing compartment 11 above, a refrigerating compartment 13 in the middle, and a vegetable compartment 15 below. Adiabatic doors 17, 19, 21 are respectively provided at the front of each compartment 11, 13, 15.s At the rear of the freezer compartment 11 there is formed a main evaporator compartment 23 that is separated from the freezer compartment 11. The main evaporator compartment 23 has a main evaporator 25 therein, and the interior thereof communicates with the interior of the freezer compartment 11 through a cold air supply port 27 formed in an upper portion of the main evaporator compartment 23 and also through a return duct 29 formed in a heat insulation wall 31 constituting a partition between the freezer compartment 11 and the refrigerating compartment 13. A cold air circulation fan 33 is provided in the rear of the cold air supply port 27. Fan 33 ejects cold air produced by the main evaporator 25 into the freezer compartment 11 through the cold air supply port 27, while air inside the freezer compartment 11 goes through the return duct 29 to return to the main evaporator compartment 23.

The cold air produced by the main evaporator is also ejected into the refrigerating compartment 13 through an air supply port of an air supply duct (not shown) formed in the rear-heat insulation wall, while air inside the refrigerating compartment 13 goes through the interior of the vegetable compartment 15 and the return duct 29 to return to the main evaporator compartment 23. A damper (not shown) is provided at an outlet of the air supply port in the air supply duct (not shown) to control the temperature in the refrigerating compartment 13. As shown in detail in FIG. 5, in a ceiling surface portion 35 of the refrigerator main body 9, there is provided the cold-accumulation material 37 which is enclosed in a heat insulating material and has the cold-accumulation evaporator 39 embedded therein. As is shown in FIG. 4, a thermosiphon 41 provided with an electromagnetic value 43 connects the cold-accumulation evaporator 39 to the main evaporator 25 in a manner permitting transfer of heat as described below. The thermosiphon 41 is constituted by a closed-loop pipeline which has working fluid, such as, e.g., refrigerant, therein. The portions of the closed-loop pipeline next to the main evaporator and the cold-accumulation evaporator are zigzag formed so as to improve heat exchange efficiency. A glass-tube defrosting heater 45 is provided below the main evaporator so as to, periodically, remove frost accumulated thereon.

Figure 2:
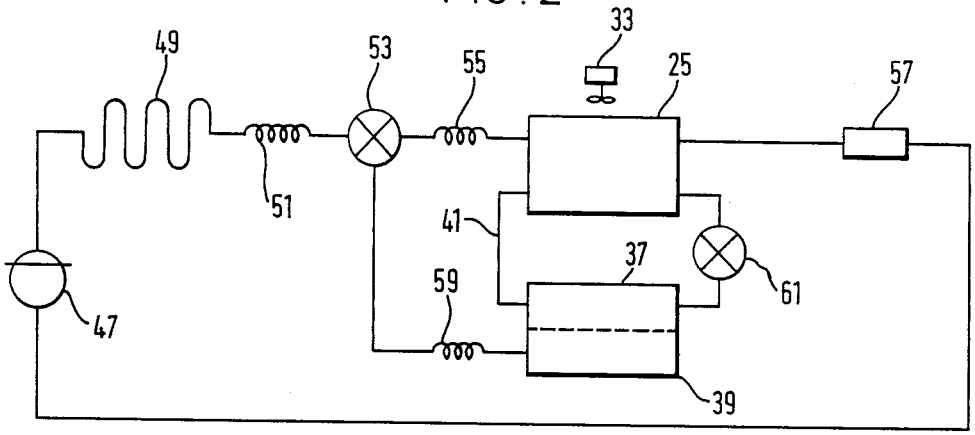
FIG. 2 is a schematic diagram of the refrigerating cycle in accordance with the present invention.

The refrigerating cycle will be described with reference to FIG. 2. A discharge side of a compressor 47 is connected through a condenser 49 and a main capillary tube 51 to an inflow side of a three-way electromagnetic valve 53. This three-way electromagnetic valve 53 has two outflow ports that are selectable for changing to change a flow path of refrigerant. One outflow port connects to an inflow port of the main evaporator 25 through a first capillary tube 55, and an outflow port of the main evaporator 25 connects to an intake side of the compressor 47 through an accumulator 57, whereby there is established a refrigerant flowpath for an ordinary cooling operation to cool the main evaporator 25 and hence the refrigerator compartments. The other outflow port of the three-way electromagnetic valve 53 connects to an inflow port of the cold-accumulation evaporator 39 through a second capillary tube 59 and an outflow port of the cold-accumulation evaporator 39 connects to the intake side of the compressor 47 through the accumulator 57, whereby there is established a refrigerant flowpath for a cold-accumulation operation to cool the cold-accumulation evaporator 39 and hence the cold-accumulation material. As noted above, the thermosiphon 41 exchanges heat between the main evaporator 25 and the cold accumulation evaporator 39. Its condensation part is arranged in thermal contact with the cold-accumulation evaporator 39 and hence the cold-accumulation material 37, and its evaporating part is arranged in thermal contact with the main evaporator 25. By the circulating flow of working fluid within the closed-loop thermosiphon 41, a cooling operation by the cold-accumulation material is performed to cool the interiors of compartments. The flow of working fluid within the thermosiphon 41 can be selectively cut off by the electromagnetic valve 61.

Figure 1:
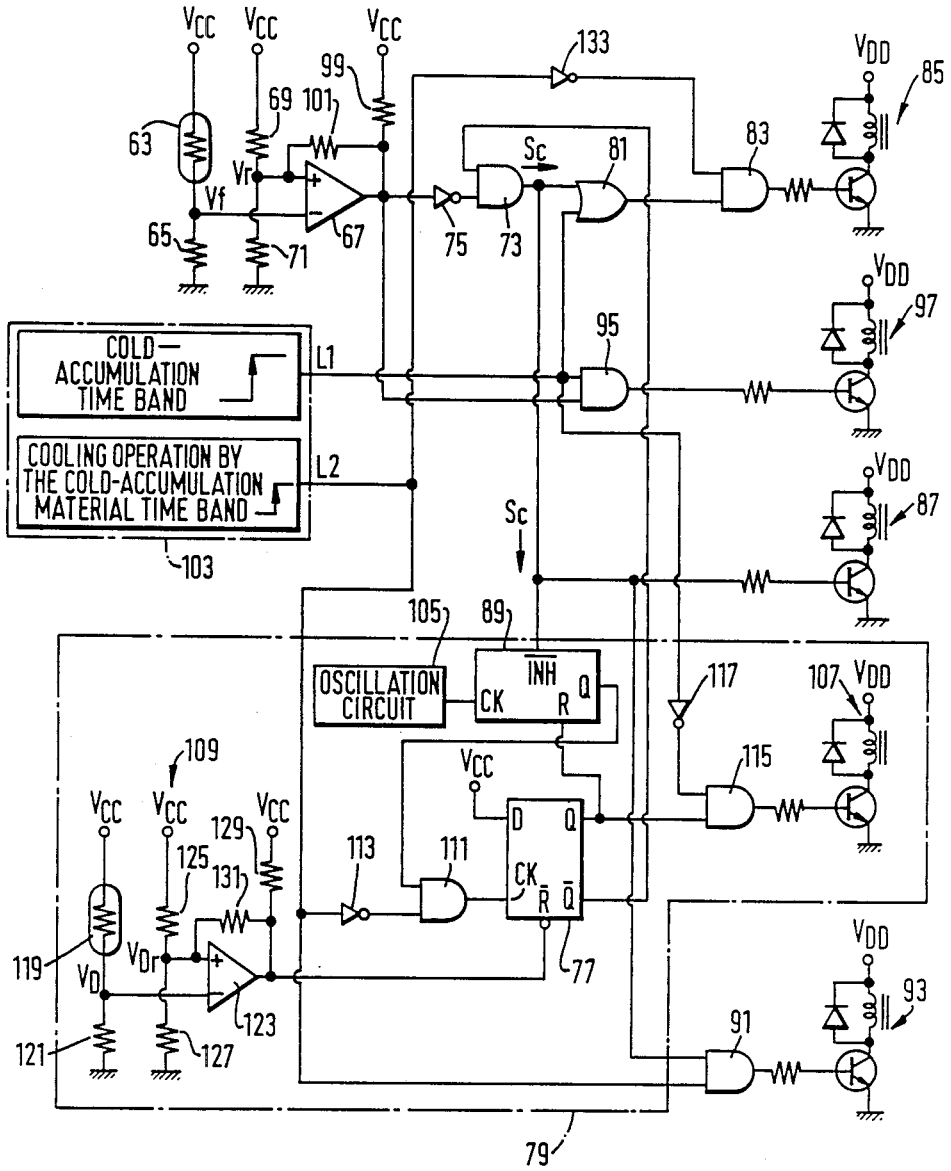
FIG. 1 is a schematic circuit diagram of part of a control device in accordance with the present invention.

A specific configuration of a control circuit for controlling the above structure is shown in FIG. 1. A temperature sensor 63, as is well known, constituted by a thermistor having negative temperature coefficient, is connected in series with a first resistor 65 between a Vcc line supplying a constant D.C. voltage and a ground line. The temperature sensor 63 detects the temperature in the freezer compartment 11. A temperature detection voltage Vf whose potential becomes higher as the freezer interior temperature becomes higher is output from the junction point of the temperature senoor 63 and the first resistor 65 to the inverting input terminal (−) of a comparator 67. The non-inverting input terminal (+) of the comparator 67 is connected with the junction point of a second resistor 69 and a third resistor 71 which are connected in series between the Vcc line and the ground line, whereby, a reference voltage Vr produced by voltage division by the second resistor 69 and the third resistor 71 is supplied to the non-inverting input terminal (+) of the comparator 67. Therefore, the comparator 67 becomes "low" if the freezer interior temperature rises above a set value, such as, e.g., −19° C. The output terminal of the comparator 67 is connected to one of the input terminals of a first AND gate 73 through a first NOT gate 75. When the comparator 67 output becomes "low" as a result of the freezer interior temperature rising above the set value, the first AND gate 73 outputs a cooling command signal Sc on condition that the inverted output terminal OH- of a D type flip-flop 77 in a defrosting control unit 79, described below, outputs a "high" signal to the other input terminal of the first AND gate 73, which means that a defrosting operation is not progress. This cooling command signal Sc is supplied successively through an OR gate 81 and a second AND gate 83 to a compressor drive circuit 85 and is also supplied directly to a fan drive circuit 87 and to an inhibit terminal INH of a counter 89 in the defrosting control circuit 79 and through a third AND gate 91 to an electromagnetic valve drive circuit 93. The output terminal of the comparator 67 is also connected through a fourth AND gate to a three-way electromagnetic valve drive circuit 97. Because the comparator 67 is an open-collector type comparator, the output terminal thereof is connected to the Vcc line through a fourth resistor 99 for the comparator 67 to output an appropriate "high" signal. Moreover, between the output terminal and the non-inverting input terminal (+) of the comparator 67, a first feedback resistor 101 is connected. A clock circuit 103 has two output lines L1 and L2. The line L1 is "high" during a time period of, e.g., from 10:00 P.M. each day to 8:00 A.M. the following day (this period will be termed "the cold accumulation time band" below) and is at "low"at other times. The line L2 is "high" during a period of, e.g., from 7:00 P.M. to 4:00 P.M. each day (this period will be termed "the cooling by the cold-accumulation material time band" below) and is "low" at in times.

A defrosting unit comprises a defrosting control circuit 79 and defrosting heater 45. Circuit 79 includes a counter 89 which makes a cumulative count of clock pulses from an oscillation circuit 105, being connected thereto at its clock terminal CK, a D type flip-flop 77, a defrosting heater drive circuit 107, and a defrosting completion detector 109. An inhibit terminal INH of the counter 89 receives the same "high" cooling command signal SC as does fan drive circuit 87, from the output terminal of the first AND gate 73. Upon receiving a "high" cooling command signal Sc, a count inhibition status is cancelled and clock pulses from the oscillation circuit 105 are counted. When a number of clock pulses corresponding to, e.g., 12.3 hours has been counted, the output terminal Q thereof is made "high". The output terminal Q of the counter 89 is connected to one of the input terminals of a fifth AND gate 111, the output of which is connected to a clock terminal CK of a D type flip-flop 77. The other input terminal of the fifth AND gate 111 is connected to the output line L2 of the clock circuit 103 through a second NOT gate 113. When output line L2 is "low" and a set count has been completed by the counter 89, clock terminal CK of the D-type flip-flop 77 is supplied with a "high" pulse. D-type flip-flop 77 has a data terminal D connected to the Vcc line and when the clock terminal CK thereof goes "high" its output terminal Q goes "high" and simultaneously its inverted output terminal goes "low". The output terminal Q of flip-flop 77 is connected to a reset terminal of the counter 89 and one of the input terminals of a sixth AND gate 115. As stated above, the inverted output terminal of flip-flop 77 is connected to the first AND gate 73. The other input terminal of the sixth AND gate 115 is connected to output line L1, of the clock circuit 103 through a third NOT gate 117. The output terminal of gate 115 is connected to the defrosting heater drive circuit 107 for supplying power to the defrosting heater 45.

The defrosting completion detector 109 has a defrost temperature sensor 119 provided in a heat transfer relation with the main evaporator 25 and connected in series with a fifth resistor 121 between the Vcc line and the ground line. The defrost temperature sensor 119 detects the temperature of the main evaporator 25 and a temperature detection voltage VD is output from the junction point of the defrost temperature sensor 119 and the fifth resistor 121 to an inverting input terminal (−) of a defrost comparator 123. Defrost temperature sensor 119 is preferably constituted by a thermistor having a negative temperature coefficient. The non-inverting input terminal (+) of the defrost comparator 123 is connected with the junction point of a sixth resistor 125 and a seventh resistor 127 which are connected in series between the Vcc line and the ground line, whereby, a reference voltage VDr produced by voltage division by the sixth resistor 125 and the seventh resistor 127 is supplied to the non-inverting input terminal (+) of the defrost comparator 123. Therefore, the defrost comparator 123 goes "low" if the temperature of the main evaporator 25 rises above a set value, such as, e.g., 13° C. The output terminal of the defrost comparator 123 is also connected to the Vcc line through an eighth resistor 129 because this defrost comparator 123 is an open-collector type comparator. Moreover, between the output terminal and the non-inverting input terminal (+) of the defrost comparator 123, a second feedback resistor 131 is connected. The output line L1, of the clock circuit 103 is also connected to the compressor drive circuit 85 through the OR gate 81 and the second AND gate 83. The output line L2 of the clock circuit 103 is also connected to the compressor drive circuit 85 through a fourth NOT gate 133 and to the electromagnetic valve drive circuit 93 through a third AND gate 91. The operation of the invention in the various time bands will be below.

(1) From 10:00 P.M. of day 1 to 8:00 A.M. of day 2.

This time band is a cold-accumulation time band. The output line L1 of the clock circuit 103 is "high" and the output line L2 of the clock circuit 103 is "low", as indicated in FIG. 6. The output terminal of the OR gate 81 is "high" regardless of the state of cooling command signal Sc, and the output terminal of the fourth NOT gate 133 is also "high". Therefore, both input terminals of the second AND gate are "high" and the second AND gate outputs a "high" signal, whereby the compressor 47 is operated regardless of the freezer compartment temperature.

When the freezer compartment temperature is sufficiently low, the output terminal of comparator 67 goes "high". Therefore, the output terminal of the fourth AND gate 95 goes "high" because both of the input terminals thereof being "high". The three-way electromagnetic valve drive circuit 97 acts to supply power to the three-way electromagnetic valve. The third AND gate 91 outputs a "low" signal when it receives a "low" signal at one of its input terminals via output line L2. In response, the electromagnetic valve drive circuit 93 causes the electromagnetic valve 61 provided in the thermosiphon41 to close by cutting power thereto. This causes the cold accumulation operation to be carried out. During such operation refrigerant is supplied from the compressor 47 to the cold-accumulation evaporator 39 and the cold-accumulation material is cooled. Normally, the compartment interior temperature does not rise during the night-time band in which this cold-accumulation operation is performed, since in most cases the refrigerator doors are not often opened and closed during this period. However, when the freezer compartment temperature does rise above a set value, because of frequent opening and closing of the door, for example, the output terminal of the comparator 67 goes "low" and therefore the output terminal of the fourth AND gate 95 goes "low". Consequently, power to the three-way electromagnetic valve 53 is cut off and refrigerant from the compressor 47 is supplied to the main evaporator 25. Simultaneously with this, a "high" cooling command signal Sc is output from the first AND gate 73, if defrosting of the main evaporator is not performed. This causes the ordinary cooling operation to be carried out in which the fan drive circuit 87 actuates the cold air circulation fan 33. Cold air produced by evaporation of refrigerant in the main evaporator 25 is supplied to the compartments to cool them. Further, since the count inhibition status of counter 89 is cancelled by a cooling command signal Sc at this time, the main evaporator 25 operation is accompanied by a count-up of clock pulses from the oscillation circuit 105 by the counter 89. When the compartment interior has been thoroughly cooled by this ordinary cooling operation, the refrigeration once again returns from ordinary cooling operation to cold-accumulation operation as the result of the output terminal of the comparator 67 returning to a "high" level.

(2) From 1:00 P.M. to 3:00 P.M.

In this time band cooling is carried out by the cold-accumulation material. The output line L1 of the clock circuit 103 is "low" and the output line L2 of the clock circuit 103 is "high", as indicated in FIG. 6.

The output terminal of the fourth NOT gate 133 is therefore "low"and so the compressor 47 is not actuated even if the freezer compartment temperature rises above a set value and the cooling command signal Sc is output from the first AND gate 73. When the freezer compartment temperature rises above a set value and the cooling command signal Sc is output from the first AND gate 73 because of the comparator 67 outputting a "low" signal, if the main evaporator is not being defrosted, the fan drive circuit 87 actuates the cold air circulation fan 33, and the third AND gate 91 output terminal goes "high" to cause the electromagnetic value drive circuit to open the electromagnetic value 61 in the thermosiphon41, since the output line L2 of the clock circuit 103 is "high" at this time. Since operation of the cold air circulation fan 33 causes comparatively high-temperature air in the compartments to flow through the main evaporator 25, the portion of the pipeline of thermosiphon41 that is located near the main evaporator 25 is heated and also the working fluid inside this portion is heated. As the electromagnetic value 61 is opened , the working fluid that has absorbed heat from the main evaporator 25 and evaporated therein passes along the pipeline of the thermosiphon41 and rises up to the cold-accumulation material section. In the cold-accumulation material section the working fluid is cooled by the cold-accumulation material which has previously been thoroughly cooled during the cold accumulation operation, and the working fluid passes further through the pipeline to return to the main evaporator 25, where it again absorbs heat from the refrigerator compartments. When the main evaporator 25 and hence the refrigerator compartments have been thoroughly cooled by this heat exchange between the main evaporator 25 and the cold-accumulation material 37 through the thermosiphon41, the output terminal of the comparator 67 becomes "high" and the cooling command signal Sc from the first AND gate 73 is cut off. Consequently power to the relay of the electromagnetic valve drive circuit is also cut, thereby terminating the cooling by the cold-accumulation material. Subsequently, each time the freezer compartment interior temperature rises above a set value, cooling by the cold-accumulation material is repeated and the refrigerator compartments are thus cooled without operating the compressor 47. Since the inhibit terminal INH of the counter 89 in the defrosting control circuit is "high" and the count inhibit status is cancelled by receiving the "high" cooling command signal Sc when cooling by the cold-accumulation material, counter 89 counts up clock pulses from the oscillation circuit 105.

(3) Period from 8:00 A.M. to 1:00 P.M. and period from 4:00 P.M. to 10:00 P.M.

During the time bands from 8:00 A.M. to 1:00 P.M. and from 4:00 P.M. to 10:00 P.M., ordinary cooling is carried out. Both of the output lines L1 and L2 of the clock circuit 103 are "low", as indicated in FIG. 6. In these time bands, therefore, the three-way electromagnetic valve drive circuit 97 allows refrigerant to flow from the compressor 47 to the main evaporator 25. The electromagnetic valve drive circuit 93 closes the electromagnetic valve 61, and the compressor 47 and the cold air circulation fan 33 are actuated to effect the ordinary cooling operation only when the cooling command signal Sc is output by the first AND gate 73. During ordinary cooling operation of refrigerator compartments, counter 89 counts up clock pulses from the oscillation circuit 103, since the "high" cooling command signal Sc cancels the counter 89 count inhibition status.

According to this invention, whatever type of cooling operation is carried out (either using the compressor/main evaporator or using the cold accumulation material/thermosiphon, a cumulative count is made in the defrosting control circuit when the cooling command signal Sc is present. This count is based on the operating time of the cold air circulation fan 33, which operates in both cooling modes. When counter 89 completes a set count in the cooling operation by the cold-accumulation material time band, defrosting does not start immediately, since the output terminal of the second NOT gate 113 is maintained "low". It is held on standby until this time band has been passed and the output line L2 of the clock circuit 103 becomes "low". The arrangement is such that the cooling by the cold-accumulation material has priority over the defrosting operation. This is because execution of the defrosting operation causes the temperature of the main evaporator 25 to rise which would be a wasteful consumption of the cooling capacity of the cold-accumulation material 37 if carried out during the time band when the refrigerator compartments were being cooled by the cold-accumulation material. When the counter 89 reaches its set count during the cold-accumulation operation time band, the output terminal A of the D-type flip-flop 77 goes immediately "high"but defrosting is not carried out, because the output terminal of the third NOT gate 117 is maintained "low". The defrosting operation is held on "standby" until the end of the time band for cooling by the cold accumulation material has passed and the output line L1 of the clock circuit 103 becomes "low". In other words, the arrangement is such that the cold-accumulation operation has priority over the defrosting operation when the refrigerator compartment temperature rises during the cold-accumulation operation time band.

However, the defrosting operation has priority over the ordinary cooling operation, therefore, when the counter 89 has counted a number of pulses corresponding to twelve hours, for example, the output terminal Q becomes "high". Power is applied to the defrosting heater 45 by the defrost heater drive 107 and the defrosting operation is carried out for a suitable time. As is described above, deposition of frost on the main evaporator 25 occurs mainly when the cold air circulation fan 33 is operated and air from inside the compartment is flowing through the main evaporator 25. Therefore, the amount of frost deposited on the main evaporator 25 is proportional to the operating time of cold air circulation fan 33. Because the cumulative count operation of the counter 89 in the defrosting circuit is effected on basis of the operating time of the cold air circulation fan 33, proper defrosting can be ensured even in the cold-accumulation type refrigerator in which there is no interrelation between the compressor 47 operating time and the amount of frost deposited on the main evaporator 25.

The present invention has been described with respect to a specific embodiment. However, other embodiments based on the principles of the present invention should be obvious to those of ordinary skill in the art. For example, in the case wherein the refrigerator is controlled by a microcomputer, the same functions as in the embodiment above may be carried out by he programs executer for the by the microcomputer, as shown in the FIG. 7 flow chart. A cumulative count of cold air circulating fan operating time is made and a defrosting operation is started in response to completion of a set count being reached. Also, for example, the thermosiphon may be constituted by sealing working fluid in a pipeline whose opposite ends are sealed. Such embodiments are intended to be covered by the claims.

What is claimed is:

1. A refrigerator including a compartment and a cold-accumulation material, comprising:
- a main evaporator for producing cold air;
- a cooling command means for generating a cooling command signal when the compartment is required to be cooled;
- clock means for generating time data;
- a refrigerating cycle for cooling the main evaporator in accordance with the cooling command signal and the cold-accumulation material in accordance with the time data; and
- defrost control means for performing a defrost operation to remove frost deposited on the main evaporator in accordance with a predetermined function of cooling time of the evaporator as indicated by the cooling command signal, said defrost operation not being performed when said cold-accumulation material is cooled.

2. A refrigerator according to claim 1, further comprising a fan for blowing cold air produced by the evaporator into the compartment, the fan being operated responsive to the cooling command signal.

3. A refrigerator according to claim 2, wherein the refrigerating cycle comprises:
- a compressor for delivering refrigerant;
- a cold-accumulation evaporator for cooling the cold-accumulation material with having heat exchangeable relation thereto;
- a first refrigerant flowpath for cooling the main evaporator by supplying refrigerant thereto from the compressor,
- a second refrigerant flowpath for cooling the cold-accumulation material by supplying refrigerant to the cold-accumulation evaporator from the compressor;
- heat transfer means for cooling the main evaporator by exchanging heat between the evaporator and the cold-accumulation material, the compressor being halted; and
- a flowpath switching means for selecting the first refrigerant flowpath or the second refrigerant flowpath respectively in accordance with the time data from the clock means.

4. A refrigerant according to claim 3 further including temperature compensating means for compensating the temperature in the compartment by making the flowpath switching means select the first refrigerant flowpath in accordance with the cooling command signal.

5. A refrigerator according to claim 3, wherein the cooling command means comprises:
- a temperature detecting circuit for detecting the temperature in the compartment and generating the cooling command signal; and
- a defrost priority circuit for prohibiting the cooling command signal from being output during the defrost operation.

6. A refrigerator according to claim 5, wherein the temperature detecting circuit comprises:
- a thermal sensor provided in the compartment for detecting the temperature therein; and
- a comparator for comparing the compartment temperature detected by the thermal sensor with a predetermined compartment temperature.

7. A refrigerator according to claim 5, wherein the defrost control means includes
- a counter circuit for counting the operation time of the fan in response to the cooling command signal and generating a defrost operation starting signal;
- a frost removing means for heating the main evaporator in response to the defrost operation starting signal; and
- a defrost completing means for supplying a defrost operation completing signal to the counter circuit to cancel the defrost operation starting signal when the accumulated frost has been removed.

8. A refrigerator according to claim 7, wherein the counter circuit includes an oscillation circuit for generating a clock pulse and a counter for counting the clock pulse when receiving the cooling command signal.

9. A refrigerator according to claim 8, wherein the frost removing means includes a glass table radiant heater for heating the evaporator, the glass tube radiant heater being provided below the evaporator.

10. A refrigerator according to claim 9, wherein the defrost completing means includes a defrost thermal sensor for detecting the temperature of the evaporator during the defrost operation and a defrost temperature comparator for comparing the evaporator temperature detected by the defrost thermal sensor with a prescribed defrost completion temperature, the defrost thermal sensor being provided with the evaporator.

11. A refrigerator according to claim 7, wherein the defrost control means further includes a cold-accumulation priority circuit for prohibiting the defrost operation when the flowpath switching means selects the second refrigerant flowpath.

12. A refrigerator according to claim 7, wherein the defrost control means further includes circuit means for prohibiting the defrost operation when the heat transfer means being operated.

13. A refrigerator according to claim 3, wherein the heat transfer means includes a thermosiphon connected with the evaporator and the cold-accumulation evaporator, the cold-accumulation evaporator being provided above the evaporator.

14. A refrigerator according to claim 13, wherein the thermosiphon includes an electromagnetic valve to be opened in accordance with the time data and cooling command signal.

15. A refrigerator according to claim 14, wherein the flowpath switching means includes a three-way type electromagnetic valve to be actuated in accordance with the time data.

* * * * *